United States Patent [19]

Junginger et al.

[11] Patent Number: 4,980,976

[45] Date of Patent: Jan. 1, 1991

[54] KNIFE WITH A STRAIGHT CUTTING PART

[75] Inventors: Klaus M. Junginger, Stuttgart; Georg Harsch, Tamm, both of Fed. Rep. of Germany

[73] Assignee: C. & E. Fein GmbH & Co., Fed. Rep. of Germany

[21] Appl. No.: 438,522

[22] Filed: Nov. 16, 1989

[30] Foreign Application Priority Data

Nov. 18, 1988 [DE] Fed. Rep. of Germany ..... 3839029

[51] Int. Cl.[5] ..... B26B 9/02; B26B 7/00

[52] U.S. Cl. ..... 30/272.1; 30/277.4

[58] Field of Search ..... 30/277.4, 272.1, 287, 30/294; 29/235, 239, 270; 7/100

[56] References Cited

U.S. PATENT DOCUMENTS

| | | | |
|---|---|---|---|
| 519,250 | 5/1894 | Pearn . | |
| 2,681,502 | 6/1954 | Black | 30/2 |
| 3,448,517 | 6/1969 | Cothery | 30/140 |
| 3,613,134 | 10/1971 | Bassett | 7/14.1 |
| 3,924,327 | 12/1975 | Edwards | 30/277 |
| 3,990,144 | 11/1976 | Schwartz | 30/123 |
| 4,080,734 | 3/1978 | Barbour | 30/123 |
| 4,199,852 | 4/1980 | Ayers et al. | 29/239 |
| 4,215,475 | 8/1980 | Morford et al. | 30/272 |
| 4,543,720 | 10/1985 | Grunikiewicz | 30/277.4 |
| 4,700,478 | 10/1987 | Mezger et al. | 30/294 |

FOREIGN PATENT DOCUMENTS

| | | |
|---|---|---|
| 0141035 | 7/1984 | European Pat. Off. . |
| 3210212 | 5/1982 | Fed. Rep. of Germany . |
| 3324676 | 10/1984 | Fed. Rep. of Germany . |
| 3626762 | 2/1988 | Fed. Rep. of Germany . |
| 762292 | 4/1934 | France . |
| 480654 | 2/1938 | United Kingdom . |

*Primary Examiner*—Douglas D. Watts

*Attorney, Agent, or Firm*—Barry R. Lipsitz

[57] ABSTRACT

In order to improve an angular, U-shaped knife for cutting tools for severing beads of adhesive on window panes of motor vehicles which is drivable about a point of rotation with a small swivel angle and at a high frequency and which comprises an attachment part with a receiving means connectable to a drive shaft coaxial with the point of rotation as first U-leg, an intermediate part as central U-leg and a cutting part as second U-leg, such that while having the same cutting capability as the curved, sickle-shaped knives it is also suitable for completely severing the bead of adhesive throughout its entire width in a corner region, it is suggested that the cutting part be of straight orientation.

15 Claims, 1 Drawing Sheet

KNIFE WITH A STRAIGHT CUTTING PART

The invention relates to an angular, U-shaped knife for cutting tools for severing beads of adhesive on window panes of motor vehicles which is drivable about a point of rotation with a small swivel angle and at a high frequency and which comprises an attachment part with a receiving means connectable to a drive shaft coaxial with the point of rotation as first U-leg, an intermediate part as central U-leg and a cutting part as second U-leg.

Such angular, U-shaped knives are known, for example, from German Pat. No. 3 324 676 and European Pat. No. 0 141 035. The former has a curved, sickle-shaped cutting part which faces away from the clamping point and the latter a curved, sickle-shaped cutting part which points towards the clamping point.

The manufacture of such knives with a curved, sickle-shaped cutting part does, however, involve great expenditure and high costs. Furthermore, a curved, sickle-shaped cutting part has the disadvantage that problems may arise during cutting of the bead of adhesive in the corner region of a frame of a motor vehicle because the sickle-shaped curvature opposes complete severing of the bead of adhesive throughout its entire width in the corner region.

The object underlying the invention is, therefore, to so improve a knife of the generic kind that while having the same cutting capability as the curved, sickle-shaped knives, it is also suitable for completely severing the bead of adhesive throughout its entire width in a corner region.

This object is accomplished, in accordance with the invention, by the cutting part being of straight orientation.

The advantage of the inventive solution is to be seen in the fact that it enables corner regions to be cut into in a simple manner and, surprisingly, the cutting characteristics are not significantly worse in the U-shaped knives than in curved, sickle-shaped cutting parts.

Particularly advantageous cutting characteristics are achievable in the U-shaped knives with a cutting part of straight orientation when the cutting part includes with a straight reference line an angle of from approximately −35 degrees to +15 degrees, seen in the clockwise direction, with the straight reference line running through the center of a foot of the cutting part and the spacing of the straight reference line from the point of rotation being at least approximately 1.5 times the radius of the receiving means.

As an alternative to the straight reference line being fixed by the point of intersection with the foot of the cutting part and the spacing from the point of rotation, it can be fixed by the feature that the intermediate part extends in a plane and that the straight reference line stands perpendicularly on this plane. In this case, it is clearly defined how the intermediate part is oriented relative to the cutting part, which is advantageous particularly if there is a small space between the window pane and the motor vehicle frame through which the intermediate part must be guided out so that when the intermediate part extends in a plane, this plane can always be guided substantially parallel to a side edge of the window pane, and owing to its orientation relative to the plane of the intermediate part, the cutting part is always in the correct angular position.

It is particularly advantageous for the conditions for the straight reference line to be fulfilled with respect to both the spacing from the point of rotation and the orientation relative to the plane of the intermediate part.

Furthermore, for reasons relating to the cutting characteristics of such a knife, it has proven expedient for a tip of the cutting part to extend at the most as far as approximately the level of the receiving means, i.e., for the tip not to extend substantially beyond the receiving means. Even if as long a cutting part as possible is desired, the tip preferably lies level with the receiving means and the cutting part then extends as far its foot which is arranged further away from the point of rotation.

To enable good piercing of the bead of adhesive by a cutting part which is of straight orientation, it is expedient for the tip to be sharpened.

The piercing is further facilitated by the cutting part tapering towards the tip.

In the description of the embodiments so far it was not indicated whether the cutting part should be ground on one or both sides thereof. To achieve as great a flexibility as possible, it has proven advantageous for the cutting part to be provided with cutting edges of straight orientation on both sides thereof.

Nor were any details given as to how the cutting part is to be ground. It is, for example, possible for the cutting part to be ground convexly on one side only. Much better cutting characteristics and, in particular, better straight-line guidance are, however, achievable when the cutting part is of outwardly curved cross-sectional shape, i.e., is convexly ground on both sides.

The inventive knife is particularly easy to manufacture when the attachment part, the intermediate part and the cutting part are made of bent, flat material.

In this case, the bending is easiest to carry out when bending lines between attachment part and intermediate part and between intermediate part and cutting part extend parallel to each other.

Regarding the spacing of the straight reference line from the point of rotation, it was merely assumed in the description of the embodiments so far that it should be at least 1.5 times the radius of the receiving means. However, since the spacing of the straight reference line from the point of rotation also affects the motions of the cutting part when the swivel angle of the oscillatory drive is fixed, it is more advantageous for the spacing of the straight reference line from the point of rotation to be at least twice the radius of the receiving means.

On the other hand, it is not purposeful for the spacing of the straight reference line from the point of rotation to be optionally large. In the maximum case, it can be assumed that the spacing of the straight reference line from the point of rotation will advantageously be smaller than five times the radius of the receiving means, preferably even smaller than four times the radius of the receiving means. Particularly favorable results with respect to the cutting power of the inventive knives were obtained with the spacing of the straight reference line from the point of rotation being approximately three times the radius of the receiving means.

To ensure that the inventive knife does not damage the frame of the motor vehicle when the pane is being taken out it is advantageous for the intermediate part to be coated with a plastic substance which serves as supporting and guiding stop and, owing to its being less hard than the frame of the motor vehicle, prevents damage to the frame.

Further features nd advantages of the inventive knife are given in the following description and the accompanying drawings of an embodiment, in which.

Figure 1:
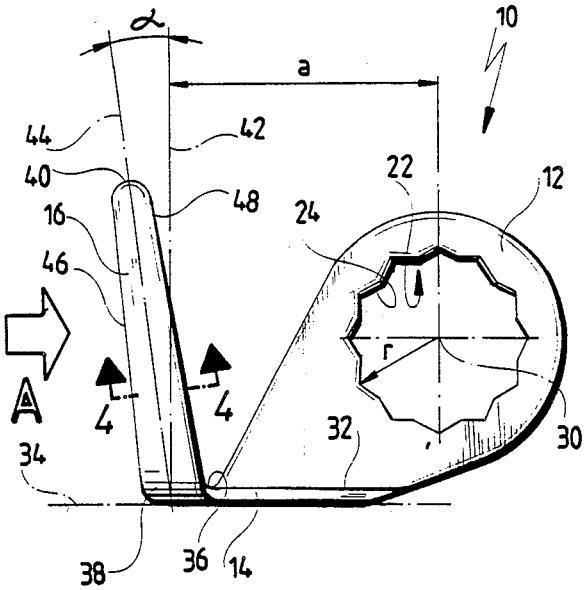
FIG. 1 is a front view of an inventive knife.
Figure 2:
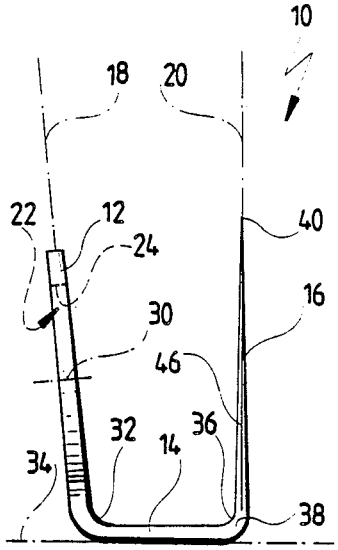
FIG. 2 is a side view in the direction of arrow A.

As shown in FIGS. 1 and 2, an embodiment of an inventive knife designated in its entirety 10 comprises a first U-leg 12 designed as attachment part which passes into a center leg of the U designed as intermediate part 14 on which a second U-leg designed as cutting part 16 is held. The attachment part 12 and the cutting part 16 lie in two planes 18 and 20 which but for deviations of a few degrees are aligned almost parallel to each other. In the embodiment shown in FIG. 2, the planes are inclined at an angle of approximately 3 degrees towards each other.

Figure 3:
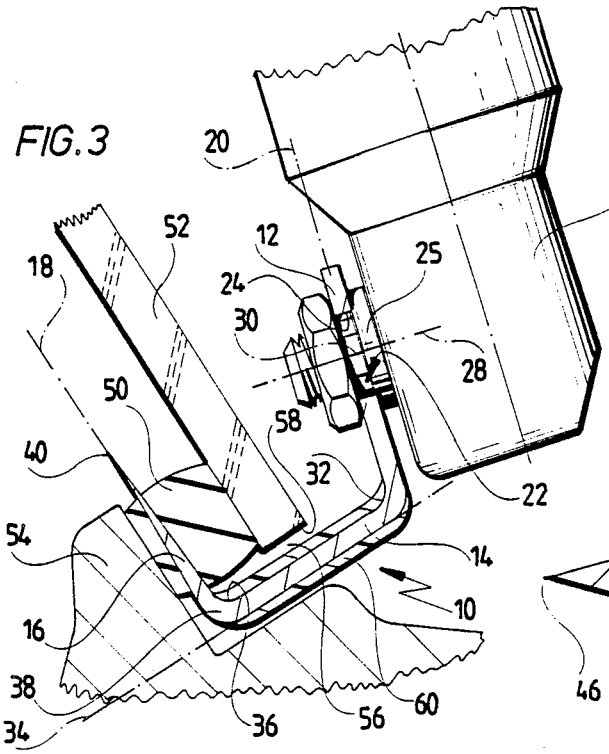
FIG. 3 is a sectional view of the inventive knife in use with an oscillatory drive.

As shown in FIG. 1, the attachment part 12 comprises a receiving means 22 with a toothed inside contour 24 so that the attachment part 12 with the receiving means 22 is mountable in a positively connected manner—as shown in FIG. 3—on a drive shaft 25 of an oscillatory drive designated in its entirety 26. The oscillatory drive 26 swivels the driveshaft 25 at high frequency in the range of 10,000 to 20,000 oscillations per minute and a small swivel angle, preferably of between 1 degree and 5 degrees. An axis of rotation 28 lies concentric with a center point of the receiving means 22 which is simultaneously a point of rotation 30 of the knife 10.

The attachment part 12 is formed from flat material and bent along a bending line 32 into the intermediate part 14 which is likewise made of flat material. The intermediate part 14 lies in a plane 34 which includes a right angle with the plane 20 in which the cutting part 16 lies and almost a right angle with the plane 18 in which the attachment part 12 lies.

The intermediate part 14 consisting of flat material is bent along a bending line 36 into the cutting part 16 which extends from a foot 38 located at the bending line 36 to a tip 40.

As shown, in particular, in FIG. 1, the cutting part 16 is offset from the point of rotation 30, more particularly, such that a straight reference line 42 intersecting the foot 38 at the center thereof and preferably standing perpendicularly on the plane 34 in which the intermediate part 14 lies, is arranged at a spacing a from the point of rotation 30. In the embodiment shown in FIG. 1, the spacing a is approximately three times the radius r of the receiving means 22, but it may also lie in the range of 1.5 to 5 times the radius r.

In relation to this straight reference line 42, the cutting part 16 can be inclined with its center line 44 lying in the plane 20 up to an angle $\alpha$ and, in the embodiment shown n FIG. 1, has an angle of inclination $\alpha$ of approximately $-8$ degrees The cutting part s preferably ground on both sides and hence has cutting edges 46 and 48 on both sides which are arranged symmetrically with the center line 44 and extend with a straight orientation from the foot 38 to the tip 40. The cutting part 16 preferably tapers towards the tip 40 so that the two cutting edges 46 and 48 do not extend parallel to each other but include an acute angle with each other.

Figure 4:
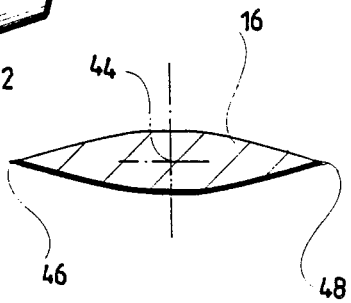
FIG. 4 is a section along line 4—4 in FIG. 1.

The cutting part 16 is preferably ground in such a way that—as shown in FIG. 4—it has an outwardly curved cross-sectional shape.

In order to sever an adhesive bead 50 which holds a window pane 52 of a motor vehicle on a frame 54 thereof, the inventive knife 10 is guided into the adhesive bead 50 in such away that its cutting part 16 extends therein and the intermediate part 14 extends outwardly in a space 56 between a side edge 5 of the window pane 52 and the frame 54. The oscillatory drive 26 holding the knife at its attachment part 12 is then guided along the side edge 58 of the window pane 52 in such a way that the cutting part 16 always extends within the adhesive bead 50 and severs it by virtue of the swivelling, oscillatory movement of the knife 10.

In order to protect the frame 54, the intermediate part 14 is preferably provided with a plastic covering 60 which simultaneously serves as supporting stop for the intermediate part 14. The covering 60 may be applied by, for example, a whirl sintering method.

The present disclosure relates to the subject matter disclosed in German application P No. 38 39 029.9 of Nov. 18, 1988, the entire specification of which is incorporated herein by reference.

What is claimed is:

1. Angular, U-shaped knife for cutting tools for serving beads of adhesive on window panes of motor vehicles which is drivable about a point of rotation with a small swivel angle and at a high frequency and which comprises an attachment part with a receiving means connectable to a drive shaft coaxial with said point of rotation as a first U-leg, an intermediate part as a central U-leg and a cutting part as a second U-leg, characterized in that said cutting part has a straight longitudinal axis and extends away from said intermediate part without curvature.

2. Knife as defined in claim 1, characterized in that said cutting part is disposed at an angle ($\alpha$) of from approximately $-35$ degrees to $+15$ degrees, seen in the clockwise direction, from a straight reference line that is perpendicular to said intermediate part and runs through the center of a foot of said cutting part, and in that the spacing of said straight reference line from said point of rotation is at least approximately 1.5 times the radius (r) of said receiving means.

3. Knife as defined in claim 1, characterized in that said cutting part includes with a straight reference line (42) an angle ($\alpha$) of from approximately $-35$ degrees to $+15$ degrees, seen in the clockwise direction, in that said intermediate part (14) extends in a plane (34), and in that said straight reference line (42) stands perpendicularly on this plane (34).

4. Knife as defined in claim 1, characterized in that a tip (40) of said cutting part (16) extends at the most to approximately the level of said receiving means (22).

5. Knife as defined in claim 1, characterized in that said tip (40) is sharpened.

6. Knife as defined in claim 5, characterized in that said cutting part (16) tapers towards said tip (40).

7. Knife as defined in claim 1, characterized in that said cutting part (16) is provided on both sides thereof with cutting edges (46, 48) of straight orientation.

8. Knife as defined in claim 1, characterized in that said cutting part (16) is of outwardly curved cross-sectional shape.

9. Knife as defined in claim 1, characterized in that said attachment part (12), said intermediate part (14) and said cutting part (16) are made of bent, flat material.

10. Knife as defined in claim 9, characterized in that bending lines (32, 36) extend parallel to each other between said attachment part (12) and said intermediate part (14) and between said intermediate part (14) and said cutting part (16).

11. Knife as defined in claim 1, characterized in that said spacing (a) of said straight reference line (42) from said point of rotation (30) is at least approximately twice the radius (r) of said receiving means (32).

12. Knife as defined in claim 1, characterized in that said spacing (a) of said straight reference line (42) from said point of rotation (30) is smaller than five times the radius (r) of said receiving means (22).

13. Knife as defined in claim 12, characterized in that said spacing (a) of said straight reference line (42) from said point of rotation (30) is smaller than four times the radius (r) of said receiving means (22).

14. Knife as defined in claim 11, characterized in that said spacing (a) of said straight reference line (42) from said point of rotation (30) is approximately three times the radius (r) of said receiving means (22).

15. Knife as defined in claim 1, characterized in that said intermediate part (14) is coated with a plastic substance (60).

* * * * *